US006364629B1

(12) United States Patent
Shintoku et al.

(10) Patent No.: US 6,364,629 B1
(45) Date of Patent: Apr. 2, 2002

(54) VALVE STRUCTURE WITH CONFIGURED RETAINER

(75) Inventors: Noriyuki Shintoku; Tomohiro Wakita; Hirofumi Sato; Mitsuyo Ishikawa, all of Kariya (JP)

(73) Assignee: Kabushiki Kaisha Toyoda Jidoshokki Seisakusho, Kariya (JP)

( * ) Notice: Subject to any disclaimer, the term of this patent is extended or adjusted under 35 U.S.C. 154(b) by 0 days.

(21) Appl. No.: 09/536,140

(22) Filed: Mar. 28, 2000

(30) Foreign Application Priority Data

Apr. 16, 1999 (JP) ..... 11-109494

(51) Int. Cl.[7] ..... F04B 1/12
(52) U.S. Cl. ..... 417/269
(58) Field of Search ..... 417/269, 275, 417/569; 137/533.19; 418/63, 55.1

(56) References Cited

U.S. PATENT DOCUMENTS

| | | | | |
|---|---|---|---|---|
| 4,737,080 A | * | 4/1988 | Owsley et al. | 417/275 |
| 5,203,686 A | * | 4/1993 | Scheldorf et al. | 418/63 |
| 5,267,839 A | * | 12/1993 | Kimura et al. | 417/269 |
| 5,345,970 A | | 9/1994 | Leyderman et al. | |
| 5,370,156 A | | 12/1994 | Peracchio et al. | |
| 5,380,176 A | * | 1/1995 | Kikuchi et al. | 418/55.1 |
| 5,396,930 A | | 3/1995 | Ebbing et al. | |
| 5,421,368 A | | 6/1995 | Maalouf et al. | |
| 5,607,287 A | * | 3/1997 | Tkeda et al. | 417/269 |
| 5,680,881 A | * | 10/1997 | Oh | 137/533.19 |
| B16,174,147 B1 | * | 1/2001 | Tarutani et al. | 417/569 |
| B16,196,815 B1 | * | 3/2001 | Ohtake | 418/55.1 |

FOREIGN PATENT DOCUMENTS

| | | |
|---|---|---|
| JP | A-5-133325 | 5/1993 |
| JP | A-8-193575 | 7/1996 |
| JP | A-8-210253 | 8/1996 |

* cited by examiner

*Primary Examiner*—Teresa Walberg
*Assistant Examiner*—Vinod D. Patel
(74) *Attorney, Agent, or Firm*—Woodcock Washburn LLP

(57) ABSTRACT

A valve structure includes a central valve plate having a valve hole, and a flexible valve element having a root portion lying on the central valve plate and a bendable portion to open and close the valve hole. A retainer element has a retaining surface to restrict deformation of the valve element when it is bent toward the retainer element to open the valve hole. The profile is expressed in a two-dimensional coordinate system (x, y), and the freely bent shape is represented by coordinates (x, f(x)) obtained by pushing the valve element at an abscissa position corresponding to the center of the valve element. The retaining surface has a profile containing a coordinate (x', f(x')−K) so that the profile is displaced toward the central valve plate with respect to a freely bent shape of the valve element.

7 Claims, 6 Drawing Sheets

VALVE STRUCTURE WITH CONFIGURED RETAINER

BACKGROUND OF THE INVENTION

1. Field of the Invention

The present invention relates to a valve structure including a wall member having a valve hole, a valve element and a retainer having a retaining surface, by which bending of the valve member is restricted by receiving the rear surface of the valve member.

2. Description of the Related Art

Japanese Unexamined Patent Publication (Kokai) No. 7-151264 discloses a piston type compressor having a discharge valve assembly. The discharge valve assembly includes a discharge valve member having a fixed root portion and a free, distal end capable of opening and closing a discharge port, and a valve stop (retainer) opposed to the valve member so that the valve member cannot be opened beyond a predetermined limit. In this prior art, in order to reduce noise caused when the valve member opens and collides against the retainer in the case of discharging compressed gas from the piston cylinder bore, the profile of the retainer is made to correspond to a bending shape of the valve member in the case where the maximum stress is given to the valve member. That is, noise caused when the valve member and the retainer collide with each other is suppressed as follows. When the profile of the retainer is designed so that the stress given to the valve member at each contact point can reach the maximum allowable stress, the positional energy of the valve member becomes maximum, and on the other hand, the valve member collides with the retainer at the moment the kinetic energy becomes minimum. In this way, noise caused when the members collide with each other can be suppressed. In brief, in this prior art, the profile of the retainer is made to agree with a freely bent shape of the valve member when the distal end portion of the valve member is pushed up in the vertical direction from the closed position.

However, in the valve structure including the retainer, there is an essential problem to be solved before solving the problem of noise caused when the valve and the retainer collide with each other. The problem is to enhance durability of the valve structure which is repeatedly opened and closed. To be specific, the enhancement of durability of the valve structure is to prevent an occurrence of breakage in which the valve member is broken at its root, and an occurrence of damage in which the valve member and/or the wall member is damaged by the collision of the valve member against the wall member forming the discharge hole (valve hole). In view of the above essential technical demands for the valve structure, the above prior art is not provided with sufficiently high durability. That is, according to the above prior art, there is a possibility of the fatigue failure on bending (break of the root) of the valve member, and also there is a possibility of the fatigue failure on impact (break) in the case of opening and closing the valve member. In other words, there is a technical problem with durability.

SUMMARY OF THE INVENTION

It is an object of the present invention to provide a valve structure, which can enhance durability with respect to the fatigue failure on bending of the valve member and the fatigue failure on impact.

According to the present invention, there is provided a valve structure comprising a wall member having a surface and a valve hole opening in said surface, said valve hole having a center, a flexible valve element having a first portion lying on said surface of said wall member and a second portion bendable toward and away from said wall member to open and close said valve hole, and a retainer element having a retaining surface to restrict deformation of said valve element when said valve element is bent toward said retainer element.

The retaining surface of said retainer element has a profile containing a coordinate (x', f(x')−K) within an abscissa range between an origin and said center of said valve hole so that said profile is displaced toward said wall member with respect to a freely bent shape of said valve element.

In this case, the profile is expressed in a two-dimensional coordinate system (x, y) having an X axis extending parallel to the surface of the wall member in the direction from the first portion toward the second portion of the valve element, a Y axis extending perpendicular to the X axis in the direction away from the wall member, and the origin near the first portion of the valve element, the origin corresponding to a start point of the profile; the freely bent shape is represented by coordinates (x, f(x)) obtained by pushing the valve element in the Y-axis direction at an abscissa position corresponding to the center of the valve element so as to urge the valve element away from the wall member; L is a distance from the origin to the center of the valve hole; H is a distance between the valve element and the wall member at an abscissa position of x=L in the freely bent shape; x' is an abscissa value satisfying the relationship of f(x')=H/2 between the origin and the center of the valve hole; and K (0<K) is a displaced value in the Y-axis direction.

The present invention also provides a compressor having a valve structure having an identical feature to that of the above described valve structure.

In this valve structure, a y coordinate value of the profile of the retaining surface of the retainer corresponding to an x coordinate value (x') satisfying the relationship of f(x')=H/2 between the origin of the two dimensional coordinate system (x, y) and the center of the valve hole is smaller than a y coordinate value of the freely bent shape of the valve element by a positive displaced value K. As a result, in the abscissa coordinate range from the origin to the center of the valve hole, the profile of the retaining surface of the retainer is displaced toward the wall member with respect to the freely bent shape (the estimated line of the valve element). Therefore, when the valve element is bent toward the retainer when opening the valve, a portion close to the root of the valve element gradually comes into contact with the retaining surface of the retainer. In this case, as the valve element is bent, the contact point (fulcrum of bend) of the rear surface of the valve element with the retaining surface of the retainer gradually moves from the origin to the distal end portion of the valve element. Consequently, according to this valve structure, when the valve element is opened, the concentration of stress upon the root of the valve element located at the coordinate origin (start point of the profile of the retaining surface of the retainer) can be avoided or reduced. Therefore, durability of the valve element with respect to the fatigue failure of bend of the valve element and the fatigue failure of impact can be enhanced. On the other hand, if a profile agreeing with the freely bent shape of the valve element is adopted as the profile of the retaining surface of the retainer, that is, if the prior art is adopted, the fulcrum point of bending of the valve element is always located at the origin of the two-dimensional coordinate system (x, y) and is not moved at all. Therefore, the stress concentration upon the root of the valve member cannot be avoided.

In the preferred form of the present invention, the distance between the retaining surface of the retainer and the wall member at the abscissa coordinate of (x=L) corresponding to the center of the valve hole is H (=f(L)), which agrees with the profile in the freely bent shape. The preferable range of the displaced value K is in the range from 3% to 20% of the distance H. The critical meanings of the upper and the lower limit will be made clear later. The profile of the retaining surface of the retainer in the abscissa range from the origin of the coordinate to the center of the valve hole can be smoothly continued to the profile of the retaining surface of the retainer in the abscissa range beyond the center of the valve hole.

BRIEF DESCRIPTION OF THE DRAWINGS

The present invention will become more apparent from the following description of the preferred embodiments, with reference to the accompanying drawings, in which.

DESCRIPTION OF THE PREFERRED EMBODIMENTS

Figure 1:
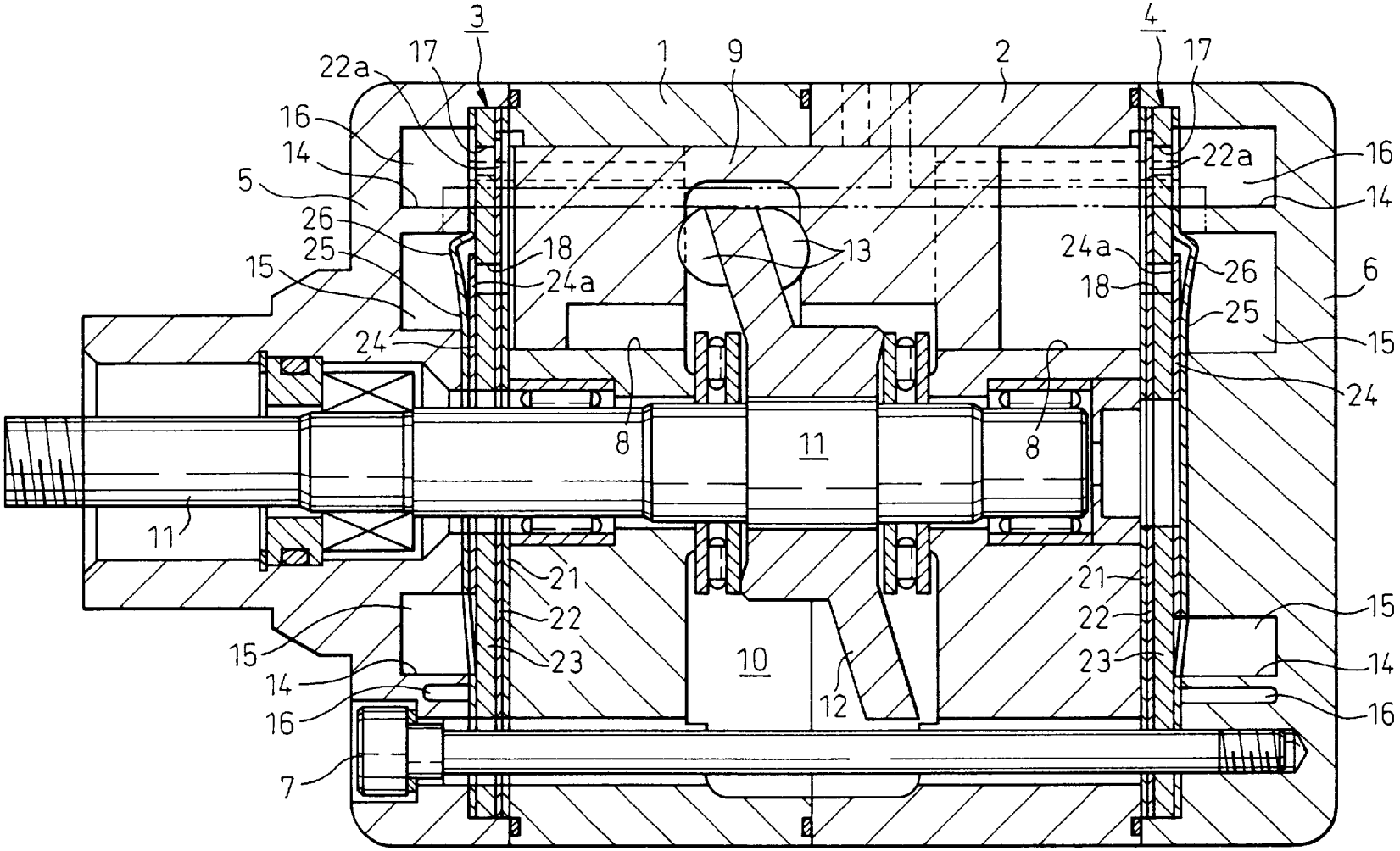
FIG. 1 is a longitudinally cross-sectional view of a swash plate type compressor according the embodiment of the present invention.

The embodiment of the present invention will now be explained, by way of an example applied to a swash plate type compressor used for an air conditioner for vehicle. FIG. 1 is a view showing a double-headed piston type swash plate type compressor having 10 cylinders. As shown in FIG. 1, the compressor includes a housing comprising a front cylinder block 1 and a rear cylinder block 2 joined to each other at the center of the drawing. Each of the cylinder blocks 1 and 2 has a plurality of (five in the embodiment) cylinder bores 8 formed therethrough in the axial direction around the central axis at equiangular intervals. A front housing cover 5 is attached to the front end of the front cylinder block 1 via a valve structure 3, and a rear housing cover 6 is attached to the rear end of the rear cylinder block 2 via a valve structure 4. One end of each cylinder bore 8 is sealed by the valve structure 3 or 4. The above members 1, 2, 3, 4, 5 and 6 are fastened and fixed together by a plurality of through-bolts 7 (only one is shown in the drawing). In this way, the compressor housing is composed of those members.

One head portion of the double-headed piston 9 is reciprocatingly accommodated in each cylinder bore 8. A compression chamber is formed in each cylinder bore 8 between each end of the piston 9 and each valve structure 3 or 4 so that the volume of the compression chamber changes according to the reciprocating motion of the piston 9. On the other hand, a crank chamber 10 is formed in the region where the front and rear cylinder blocks 1 and 2 are joined to each other. A drive shaft 11 is rotatably arranged in this crank chamber 10. The front end portion of the drive shaft 11 protrudes outside from the compressor housing and is operatively connected to an external drive source such as a vehicle engine via a power transmitting mechanism (not shown) such as an electromagnetic clutch. A swash plate 12 is arranged in the crank chamber 10, and mounted to the drive shaft 11 for rotation therewith. The outer circumferential portion of the swash plate 12 is engaged with each piston 9 via a pair of front and rear shoes 13. With this arrangement, the rotational movement of the drive shaft 11 is converted into a linear reciprocating movement of the piston 9 via the swash plate 12 and the shoes 13.

Each of the front and rear housing covers 5 and 6 has an annular partition wall 14 formed therein. By this partition wall 14, a space surrounded by each housing cover 5 or 6 and the corresponding valve structure 3 or 4 is divided into a discharge chamber 15, which is located inside the partition wall 14, and a suction chamber 16, which is located outside the partition wall 14. The suction chamber 16 and the discharge chamber 15 are connected with each other by an external refrigerant circuit (not shown in the drawing), which constitutes, with this compressor, a refrigeration circuit of an air conditioner for vehicle use. Refrigerant gas recirculating from the external refrigerant circuit into the suction chamber 16 is sucked into the cylinder bore 8 via a suction port and a suction valve of the valve structure 3 or 4, described later, according to the motion of each piston 9 in one direction. After the refrigerant gas is sucked into the cylinder bore 8, it is compressed by the returning motion of each piston 9 and then discharged into the discharge chamber 15 via a discharge port and a discharge valve of each valve structure 3 or 4. This refrigerant gas at high pressure is delivered to the external refrigerant circuit again.

Figure 4:
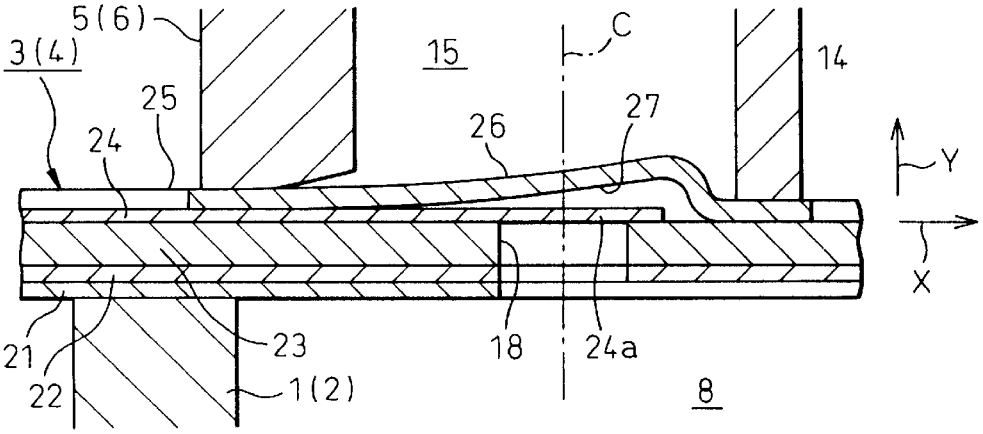
FIG. 4 is a cross-sectional view of a portion of the compressor around the retainer plate, taken on line IV—IV in FIG. 3.

The two valve structures 3 and 4 are assemblies having equivalent structures and functions. As shown in FIGS. 1 and 4, each valve structure 3 or 4 includes an inside gasket 21, a suction valve forming plate 22, a central valve plate 23 as a wall member, a discharge valve forming plate 24, and a retainer plate 25 which also functions as an outside gasket. Those members are put on each other, from the cylinder block, in this order.

The central valve plate 23 has suction ports 17 and discharge ports (valve holes) 18 corresponding to the cylinder bores 8. The suction port 17 connects the suction chamber 16 to the compression chamber in each cylinder bore 8. The discharge port 18 connects the compression chamber in each cylinder bore 8 to the discharge chamber 15. The inside gasket 21 has through-holes corresponding to the cylinder bores 8 and the suction ports 17 and the discharge port 18 of the central valve plate 23. The suction valve forming plate 22 has suction valves 22*a* capable of opening and closing respective suction ports 17 of the central valve plate 23. In addition, the discharge valve forming plate 24 has a discharge valves 24*a* capable opening and closing the respective discharge ports (valve holes) 18 of the central valve plate 23. Both the suction valves 22*a* and the discharge valves 24*a* are flexible tongue-shaped valve elements capable of opening and closing the corresponding ports. It is preferable that the suction valves 22*a* and the discharge valves 24*a* are flapper-type reed valves.

Figure 2:
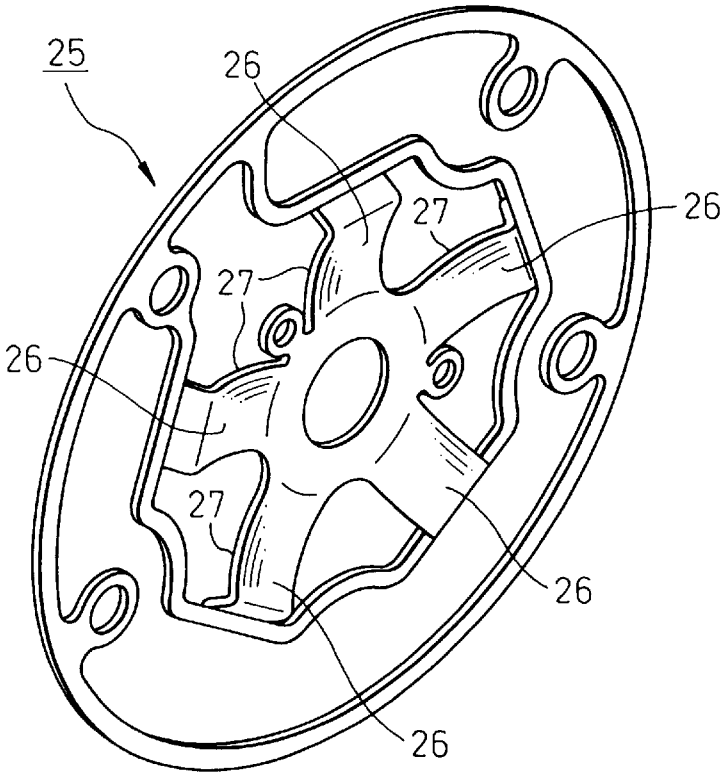
FIG. 2 is a perspective view of the retainer plate of FIG. 1.

The retainer plate 25 as the outside gasket, which is arranged adjacent to the outside of the discharge valve forming plate 24 in each valve structure 3 or 4, has an overall shape as shown in FIG. 2. The retainer plate 25 has a plurality (five in the embodiment) of retainer elements 26, which extend substantially radially corresponding to the discharge valves 24*a* arranged in the discharge valve forming plate 24. The retainer elements 26 are portions or elements which determine the maximum value of bending of the corresponding discharge valves 24*a* to control the maximum opening of the discharge valves in order to protect the discharge valves 24*a*. Therefore, each retainer element 26 has a retaining surface 27 opposed to the rear surface of the discharge valve 24*a* and capable of receiving (abutting against) the rear surface of the discharge valve 24*a* which is bent toward the retainer element as shown in FIGS. 2 and 4. In this connection, the outer shape of the retainer plate 25 is determined when a metal material is processed, but after processing the outer shape of the retainer plate 25, the surface of the plate is coated with a layer of rubber (not shown in the drawing) having the thickness of several tens to several hundreds $\mu$m, so that the retainer plate 25 also functions as a gasket.

Figure 3:
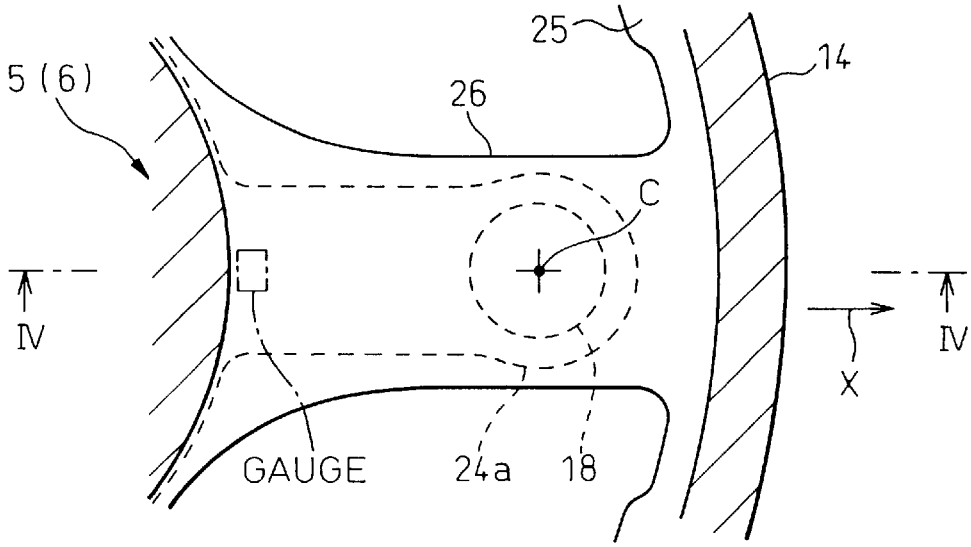
FIG. 3 is a plan view of a portion of the retainer plate including one retainer element, viewed from the discharge chamber.

As shown in FIGS. 1, 3 and 4, the root portions (base end portions) of the retainer elements 26 are sandwiched between and held by a portion of the housing cover 5 or 6 (a partition wall in the discharge chamber 15) and a portion of the valve structure starting from the discharge valve forming plate 24 plus the cylinder block 1 or 2. The distal end portions of the retainer elements 26 are sandwiched between and held by the partition wall 14 and a portion of the valve structure starting from the central valve plate 23. Each retainer element 26 is configured to generally curve in such a manner that it gradually separates away from the central valve plate 23 as the position changes from the base end portion to the distal end portion (that is, from the left to the right in FIG. 4). The profile of the retaining surface 27 substantially corresponds to the curved profile of the retainer element 26. A portion of the retaining surface 27 of each retainer element 26 at the longitudinally central region is opposed to the discharge port 18 via the discharge valve 24*a*.

Figure 5:
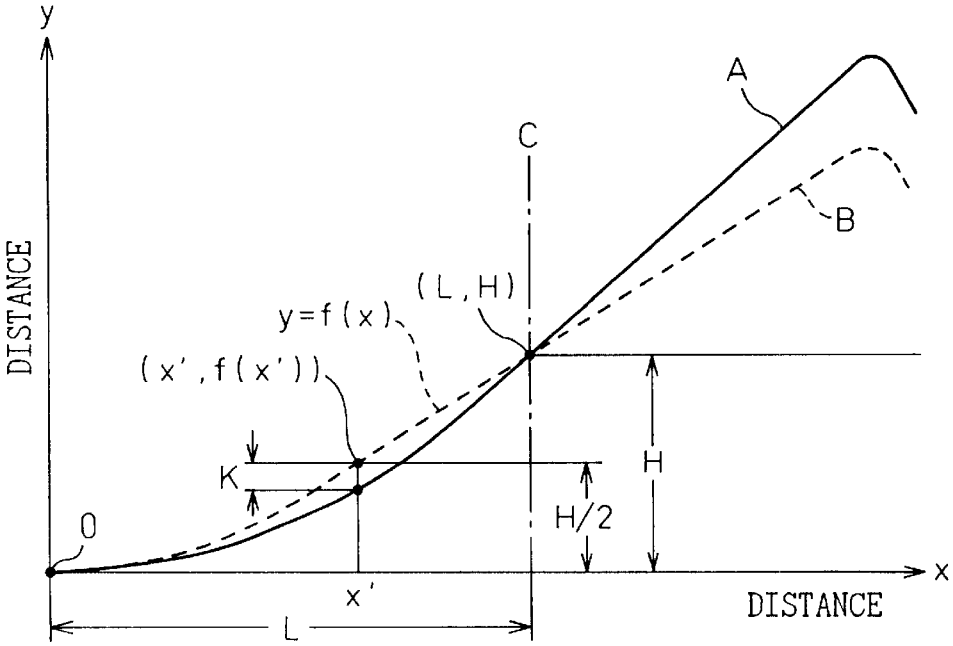
FIG. 5 is a graph showing the profile of the retaining surface of the retainer plate in the x–y coordinate system.

This embodiment is characterized in the setting of the profile of the retaining surface 27 of the retainer element 26 opposed to the rear surface of the discharge valve 24*a*. Referring to FIGS. 4 and 5, the setting of the profile of the retaining surface 27 will be explained below. In FIG. 5, the profile (shown by the solid line A) of the retaining surface 27 is mathematically described, using a two-dimensional coordinate system (x, y) having an X axis and a Y axis. The X axis of the coordinate system agrees with the extending direction of the discharge valve (valve element) 24*a* and the central valve plate (wall member) 23 when the discharge port (valve hole) 18 is closed. That is, the X axis extends parallel to the surface of the central valve plate 23 and in the direction from the root portion (first portion) toward the central portion (second portion) of the discharge valve 24*a*. The Y axis of the coordinate system is perpendicular to the X axis and directed in the bending direction (away from the central valve plate 23) of the discharge valve 24*a*. In the two-dimensional coordinate system, in order to simplify the mathematical description, the start point of the profile of the retaining surface 27, which starts at a position close to the root portion of the discharge valve 24*a*, is assumed to be the origin (0, 0) of the coordinate system (x, y). Further, the distance from the origin to center C of the discharge port 18 is represented by L.

In the graph of FIG. 5, a freely bent shape or profile (broken line) B of a retainer in the prior art is shown as a comparative example, in addition, to the profile (solid line) A of the retaining surface 27 of the embodiment. It can be considered that the comparative example is equivalent to a valve stop disclosed in the prior art (Japanese Unexamined Patent Publication No. 7-151264). The freely bent shape B of the comparative example shown in the graph of FIG. 5 is defined as follows. Under the condition that the retainer 26 is removed from the arrangement shown in FIG. 4, the discharge valve 24*a* is pushed in the Y-axis direction (that is, the discharge valve 24*a* is pushed in the direction from the cylinder bore 8 to the discharge chamber 15) at the abscissa position corresponding to the center C of the valve hole (the center of the discharge port 18) so as to separate the discharge valve 24*a* from the center valve plate 23. The freely bent shape of the discharge valve 24*a* is represented by the coordinates (x, f(x)), by plotting the measured points on the graph. In this case, function f(x) showing the y coordinate of the freely bent profile of the discharge valve 24*a* can be substantially expressed by the following equation (1) in the abscissa range from the origin to valve hole center C.

$$f(x)=H\{1-3(L-x)/2L+(L-x)^3/2L^3\} \quad (1)$$

However, in the abscissa range beyond the center C of the valve hole, the function f(x) showing the y coordinate does not necessarily agree with the equation (1) described above. In this connection, as shown in FIG. 5, when the separation distance between the discharge valve 24*a* at the pushing position (x=L) in the freely bent condition and the central valve plate 23 is represented by H, the equation f(L)=H is established.

Concerning the freely bent shape described above, the profile of the retaining surface 27 of the retainer element 26 of this embodiment is set in such a manner that it is displaced toward the central valve plate 23 in the abscissa range from the origin to the center C of the valve hole with respect to the freely bent shape of the estimated line (broken line in FIG. 5) of the discharge valve 24*a* in free bend. More specifically, a position on the curve of the function f(x) of the freely bent shape B corresponding to one half of the separation distance H, which is the distance between the discharge valve 24*a* at the pushing point and the central valve plate 23, that is, a coordinate (x', f(x')) is used as a reference, and a position of the retaining surface 27 is displaced toward the central valve plate 23 by a displaced value K (0<K). In other words, in the case where x' is a value of an abscissa satisfying the relationship of f(x')=H/2 between the origin and the center C of the valve hole, the profile of the retaining surface 27 is set by a curve passing through the coordinate (x', f(x')−K). This profile contains not only the origin and the coordinate (x', f(x')−K) but also the coordinate (L, f(L))=(L, H). In this connection, the displaced value K in the Y axis direction is set at approximately 3% to 20% (preferably, 5% to 18%) of the separation distance H. When the displaced value K is smaller than 3% of the separation distance H, a difference between the profile of the retaining surface 27 and the freely bent shape is small, and the required effect of purposely approaching the displaced value K is reduced. On the other hand, when the displaced value K exceeds 20% of the separation distance H, there is a possibility that an excessively strong force is given to the discharge valve 24*a* when the valve is opened.

In the abscissa range from the center C of the valve hole to the distal end of the discharge valve, the profile of the retaining surface 27 is not necessarily restricted. However, in order to ensure that the profile is smoothly continued to the profile displaced toward the central valve plate 23 in the abscissa range from the origin to the center C of the valve hole, as shown in FIG. 5, it will be preferable to set the profile in such a manner that the profile is displaced onto the side away from the central valve plate (wall member) 23 with respect to the freely bent shape or the estimated line (broken line B in FIG. 5) of the discharge valve 24*a*. In this connection, it is possible to easily set the profile (solid line on FIG. 5) of this embodiment in the abscissa range beyond the center C of the valve, by using the profile in the abscissa range from the origin to the center C of the valve hole as a reference and drawing a tangential line at the coordinate (L, H) of the reference.

Figure 6:
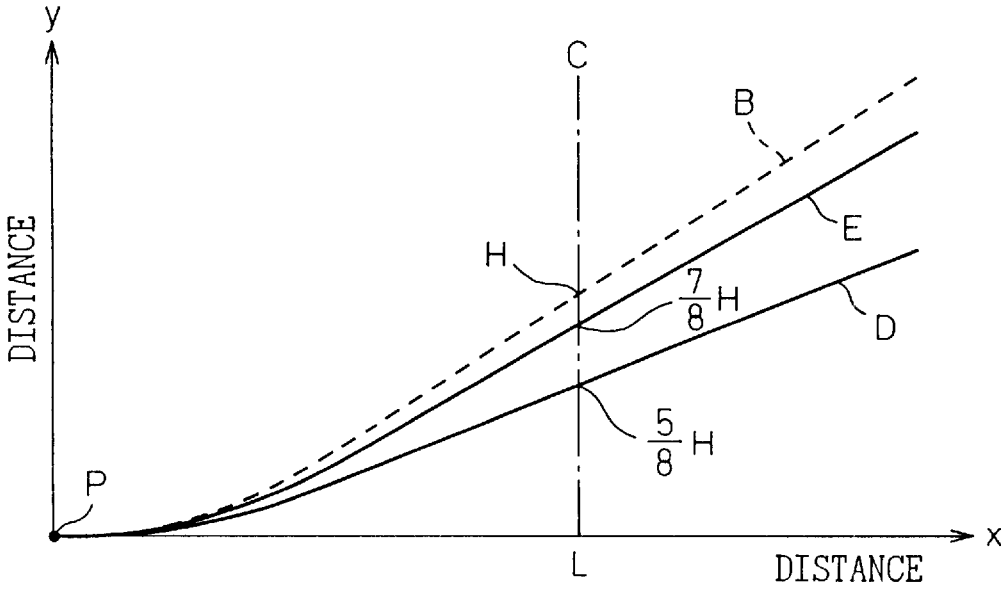
FIG. 6 is a graph similar to FIG. 5, showing bending shapes of a discharge valve in a comparative example.
Figure 7:
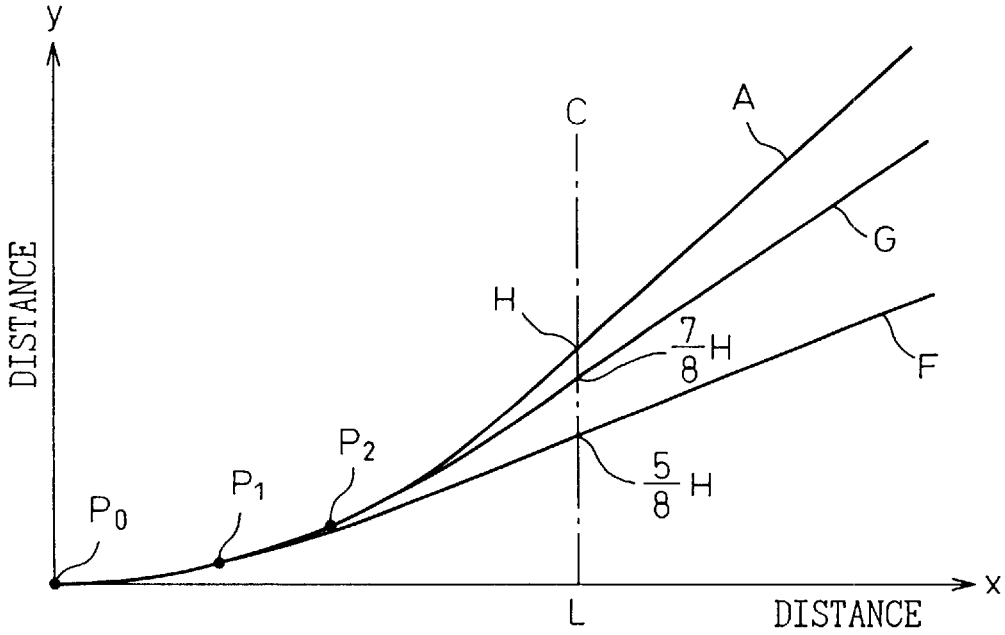
FIG. 7 is a graph similar to FIG. 5, bending shapes of the discharge valve in the present embodiment.

A difference between the profile of this embodiment and that of the comparative example appears as a difference in the function of the retainer whether a fulcrum point of bending of the discharge valve is moved or not in the process of opening and closing the discharge valve 24*a*. FIG. 6 is a conceptual view of the bending shape of the discharge valve in the comparative example under the condition where the lift of the discharge valve at the center C of the valve hole is set at ⅝ and ⅞ of the separation distance H (curves D and E). In the similar manner, FIG. 7 is a conceptual view of the bending shape of the discharge valve in this embodiment under the condition where the lift of the discharge valve at the center C of the valve hole is set at ⅝ and ⅞ of the separation distance H (curves F and G). In the case of the comparative example shown in FIG. 6, even if the lift of the discharge valve is variously changed, the fulcrum point P of bending of the discharge valve is always located at the origin of the x–y coordinate system, and it is not moved. On the other hand, in the case of this embodiment shown in FIG. 7, as the lift of the discharge valve is increased, the substantial fulcrum point of bending of the discharge valve gradually approaches the center C of the valve hole as P0→P1→P2. The difference in the characteristics in use derives from a difference in the bending stress of the discharge valve 24*a* and a difference in the speed of collision of the discharge valve 24*a* against the central valve plate 23 when the discharge valve 24*a* closes the valve hole 18 again.

Figure 8:
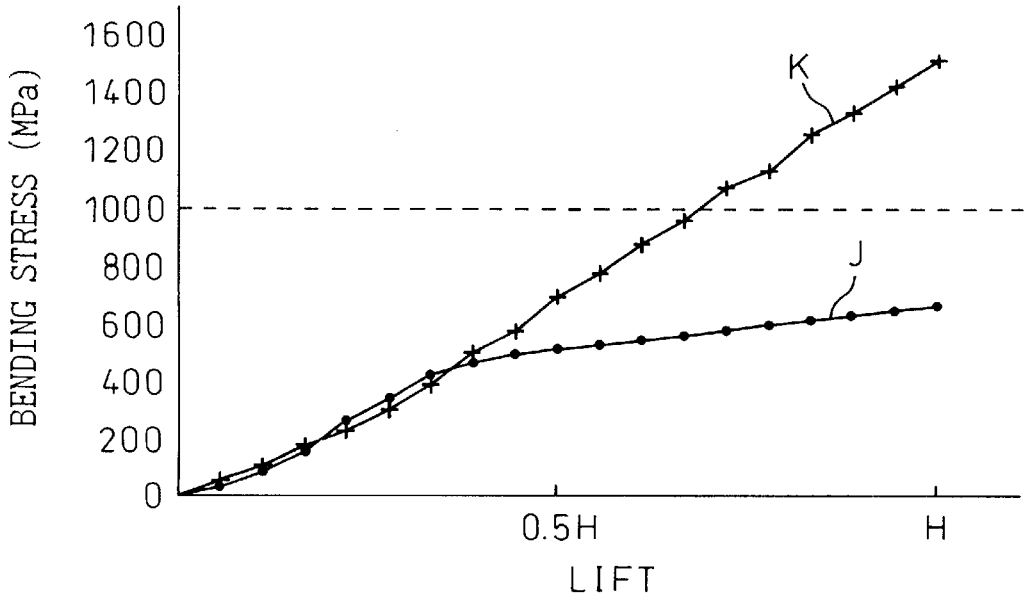
FIG. 8 is a graph showing the relationship between the lift of the discharge valve and bending stress.

FIG. 8 is a graph showing the relationship between the lift of the discharge valve 24*a* at the center C of the valve hole and the actually measured value of bending stress created in the discharge valve in the case of lifting. The bending stress was measured by a gauge which is attached to a portion close to the root of the retainer element 26, as shown by one dotted-chain line in FIG. 3. As can be seen in FIG. 8, in the case of the comparative example (curve K), the bending stress is increased substantially proportional to an increase in the lift. On the other hand, in the case of this embodiment (curve J), when the lift is increased, the bending stress increases, but the tendency to increase the bending stress becomes very gentle when the lift exceeds 0.3 H. Accordingly, assuming that the fatigue limit of the discharge valve 24*a* is 1000 Mpa, due to a selected material composing the discharge valve 24*a* or other reasons, when the maximum lift is not less than 0.7 H, the valve of the comparative example may often be broken but, in the present embodiment, the bending stress of the valve does not reach a level at which the valve is broken. As described above, according to the structure of this embodiment, even when the lift of the valve is increased, an increase in the bending stress of the discharge valve can be suppressed. As a result, the valve member will not be broken by the fatigue of bending.

Figure 9:
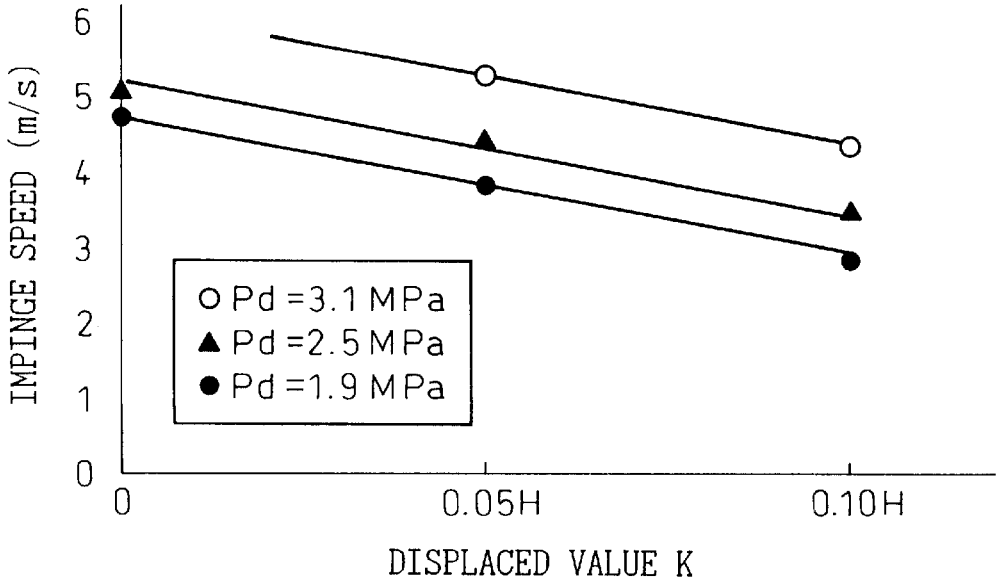
FIG. 9 is a graph showing the relationship between the displaced value K and the speed of collision of the discharge valve.

FIG. 9 is a view showing a speed of the discharge valve 24*a* which collides against the central valve plate 23 in the case of closing the valve hole 18 again when the displaced value K of the profile is set at 0, 0.05 H and 0.10 H in the retainer of this embodiment. Black circles shown in FIG. 9 represent data in the case where the gas pressure (discharge pressure Pd) discharged from the cylinder bore 8 to the discharge chamber 15 is 1.9 Mpa. Black triangles represent data in the case where the discharge pressure Pd is 2.5 Mpa, and white circles represent data in the case where the discharge pressure Pd is 3.1 Mpa. In this connection, the case in which K=0 is the same as the comparative example. As can be seen in FIG. 9, in any case of the discharge pressure Pd, the speed of collision in the structure of this embodiment is lower than in the comparative example. In general, there is a tendency that the more the displaced value K is increased, the less the collision speed is decreased. As described above, according to the structure of this embodiment, the collision speed of the discharge valve 24*a* against the central valve plate 23 is decreased, so that the valve element is less damaged by the fatigue of impact.

Figure 10:
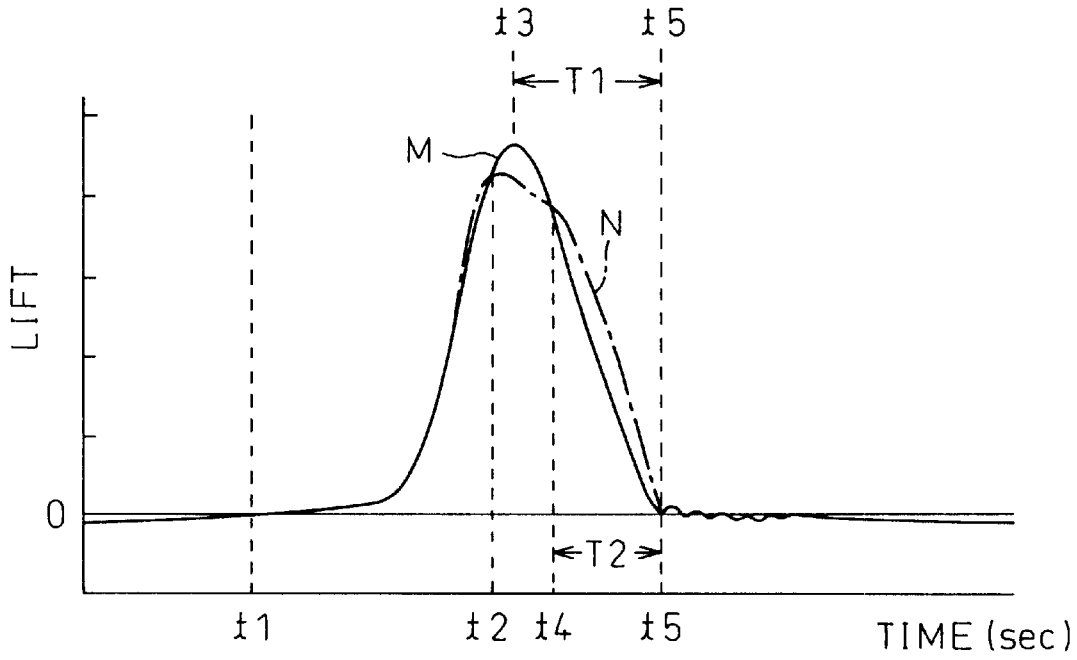
FIG. 10 is a graph showing the change in the lift of the discharge valve with respect to time.

The tendency that the collision speed of this embodiment can be decreased more than that of the comparative example can be apparently explained with reference to the graph of FIG. 10. FIG. 10 is a view showing a change in the lift of the discharge valve 24*a* with respect to time in each case of the present embodiment and the comparative example.

The opening and closing motion of the discharge valve 24*a* (that is, the change in the lift) is caused at the end of the compression stroke in which the piston 9 is returned from the bottom dead center to the top dead center (at which the piston 9 comes to the closest position to the valve structure). The circumstances will be specifically explained as follows. When the piston 9 is moved from the bottom dead center to the top dead center, the pressure in the cylinder bore is raised. At the time t1 when the pressure in the cylinder bore exceeds the pressure in the discharge chamber, the discharge valve starts opening. As the lift of the discharge valve is increased, an elastic repulsion force of the discharge valve (an elastic force of a spring to return to the initial position) is gradually increased. However, as long as the force of the discharge flow from the cylinder bore is superior to the elastic repulsion force of the discharge valve, the lift of the discharge valve continues to increase. On the other hand, when the pressure of the discharge flow from the cylinder bore is gradually reduced and the elastic repulsion force accumulated in the discharge valve becomes relatively superior to the force of the discharge flow, the discharge valve starts to move in the closing direction, and the lift gradually decreases. At the time t5 when the pressure in the cylinder bore and the pressure in the discharge chamber are balanced with each other, the discharge valve is completely closed, and the elastic repulsion force becomes zero. As described above, concerning the circumstances of the start and end of opening of the discharge valve, the present embodiment is the same as the comparative example. However, concerning the behavior of the lift before and after the discharge valve is completely opened, the present embodiment and the comparative example are slightly different from each other. Accordingly, the collision speed of the discharge valve of the present embodiment is different from that of the comparative example when the discharge valve is completely closed.

That is, in the case of the present embodiment shown by the solid line M in FIG. 10, the lift reaches a peak at the time t3, and the curve of the lift itself has a regular shape like a normal distribution curve. Especially in the case of the present embodiment, since the retainer profile is displaced toward the central valve plate 23 with respect to the estimated line of free bend (freely bent shape), and is curved to the greater extent, force is quickly accumulated by the discharge valve with the increase in the lift. Consequently, as soon as the elastic repulsion force becomes superior to the force of the discharge flow, the discharge valve immediately starts moving in the closing direction by the elastic repulsion force. According to the actual measurement, the time T1 (=t5−t3) required for completely closing the valve having the peak lift (actual value 0.93 mm) at the time t3 is about 0.0003 sec, and the average closing speed of the valve is about 3.1 m/sec.

On the other hand, in the comparative example shown by one-dotted chain line N in FIG. 10, although the lift reaches a peak at the time t2, the lift hesitantly decreases from the time t2 to the time t4, and the lift decreases from the time t4 to the time t5 at one stroke. The reason why the lift decreases by two stages is that the quantity of accumulated elastic repulsion force is smaller than that of the present embodiment, if an absolute value of the lift is the same, since the profile of the retainer agrees with the freely bent profile of the discharge. That is, the discharge valve does not have enough elastic repulsion force to strongly defeat the force of the discharge flow from the cylinder bore for a predetermined period of time (t4−t2) immediately after the lift has reached the peak. For the above reasons, during the period of time (t4−t2) in which the force of the discharge flow is reduced a little, the lift hesitantly decreases. After the time t4 when the elastic repulsion force of the discharge valve exceeds the force of the discharge flow, the discharge valve is closed at one stroke by the elastic repulsion force of the valve and the pressure difference between the inside and the outside of the valve. Accordingly, it should be understood in the comparative example that the period in which the discharge valve substantially conducts a closing motion is not the period of time (t5−t2) but the period of time T2 (=t5−t4). The actually measured value of the lift at the time t4 is 0.80 mm, the actually measured value of required time T2 is about 0.00023 sec, and the average closing speed of the valve is about 3.5 m/sec. This average closing speed is higher than the average closing speed (about 3.1 m/sec) of the present embodiment.

The present invention can provide the following effects.

According to the retainer profile of this embodiment, there is a tendency that an increase in the bending stress of the valve member 24*a* is suppressed when opening the valve. Therefore, the present embodiment is remarkably superior to the comparative example in view of durability of the valve with respect to fatigue failure of bending.

According to the retainer profile of this embodiment, there is a tendency that the collision speed of the valve member 24*a* against the central valve plate 23 when closing the valve hole 18 by the valve member 24*a* is decreased. Therefore, the present embodiment is remarkably superior to the comparative example in view of durability with respect to the fatigue failure of impact.

In the continuous operation of the compressor, a problem may occur in which a rubber coating on the retainer surface is affected and deteriorated by the influence of the discharged gas of high temperature and high pressure and this rubber extends out of a reference position at the boundary between the partition wall portion of the housing cover 5 or 6 and the central valve plate 23, and as a result, the start point of the retainer profile deviates from the origin of the two dimensional coordinate system and apparently moves in the X axis direction. In this regard, the structure of the present embodiment is advantageous in that the fulcrum point of bend of the valve can move according to the lift of the discharge valve, and the deviation can be absorbed, even if an unexpected deviation of the start point is caused by the deterioration of rubber. Therefore, the valve structure can function with the predetermined performance without any problem.

The present invention can be modified in various forms within the scope and spirit of the present invention. For example, the rubber coating on the surface of the retainer plate 25 may be omitted.

The present invention is not limited to a swash plate type compressor, but can be applied to all devices having a valve structure including a flexible valve element such as a reed valve and a retainer.

As described above in greater detail, according to the valve structure of the present invention, durability with respect to fatigue failure of bending and fatigue failure of impact of the valve element can be more enhanced than that of the conventional example.

What is claimed is:

1. A valve structure comprising:

a wall member having a surface and a valve hole opening in said surface, said valve hole having a center;

a flexible valve element having a first portion lying on said surface of said wall member and a second portion bendable toward and away from said wall member to open and close said valve hole;

a retainer element having a retaining surface to restrict deformation of said valve element when said valve element is bent toward said retainer element; and said retaining surface of said retainer element having a profile;

where said profile is expressed in a two-dimensional coordinate system (x, y) having an X axis extending parallel to said surface of said wall member in the direction from said first portion toward said second portion of said valve element, a Y axis extending perpendicular to said X axis in the direction away from said wall member, and said origin near said first portion of said valve element, said origin corresponding to a start point of said profile;

said freely bent shape is represented by coordinates (x, f(x)) obtained by pushing said valve element in the Y-axis direction at an abscissa position corresponding to said center of said valve element so as to urge the valve element away from the wall member;

L is a distance from the origin to the center of the valve hole;

H is a distance between the valve element and the wall member at an abscissa position of x=L in the freely bent shape;

x' is an abscissa value satisfying the relationship of f(x')=H/2 between origin and the center of the valve hole; and K (0<K) is a displaced value in the Y-axis direction;

wherein said profile of said retaining surface contains a coordinate (x', f(x')−K) within an abscissa range between an origin and said center of said valve hole so that said profile is displaced toward said wall member with respect to a freely bent shape of said valve element.

2. A valve structure according to claim 1, wherein the profile of the retaining surface of the retainer is set so as to contain not only the coordinate (x', f(x')−K) but also a coordinate (L, f(L)).

3. A valve structure according to claim 1, wherein the displaced value K is set from 3% to 20% of the distance H between the valve element and the wall member at x=L.

4. A valve structure according to claim 1, wherein the function f(x) showing the ordinate coordinate of the profile of the freely bent shape of the valve element in the abscissa range from the origin to the center of the valve hole is represented by the following equation;

$$f(x)=H\{1-3(L-x)/2L+(L-x)^3/2L^3\} \quad (1)$$

5. A valve structure according to claim 1, wherein the profile of the retaining surface of the retainer is displaced away from the wall member with respect to the freely bent shape of the valve element so that the retaining surface of the retainer can be separated away from the wall member.

6. A compressor comprising:

a housing having a plurality of cylinder bores;

a suction chamber;

a discharge chamber;

pistons movably arranged in said cylinder bores to cause a gas to be sucked and compressed in said cylinder bores in said housing;

a valve structure allowing selective fluid communication between said suction chamber and said cylinder bores;

a first valve plate arranged at one end of said housing, said first valve plate having a surface and a plurality of valve holes opening in said surface corresponding to said cylinder bores, each of said valve holes having a center;

a discharge valve plate arranged on the outer side of the first valve plate and having a plurality of flexible discharge valve elements corresponding to said valve holes, each of said discharge valve elements having a first portion lying on said surface of said first valve plate and a second portion bendable toward and away from said first valve plate to open and close said valve hole, said discharge chamber being in fluid communication with said cylinder bore when said discharge valve element is open;

a retainer arranged on the outer side of said discharge valve plate and having a plurality of retainer elements corresponding to said discharge valve elements, each of said retainer elements having a retaining surface to restrict deformation of said discharge valve element when said discharge valve element is bent toward said retainer element;

said retaining surface of said retainer element having a profile;

where said profile is expressed in a two-dimensional coordinate system (x, y) having an X axis extending parallel to said surface of said first valve plate in the direction from said first portion toward said second portion of said discharge valve element, a Y axis extending perpendicular to said X axis in the direction away from said first valve plate, and said origin near said first portion of said discharge valve element, said origin corresponding to a start point of said profile;

said freely bent shape is represented by coordinates (x, f(x)) obtained by pushing said valve element in the Y-axis direction at an abscissa portion corresponding to said center of said discharge valve element so as to urge the discharge valve element away from the first valve plate;

L is a distance from the origin to the center of the valve hole;

H is a distance between the discharge valve element and the first valve plate at an abscissa position of x=L in the freely bent shape;

x' is an abscissa value satisfying the relationship of f(x')=H/2 between the origin and the center of the valve hole; and K (0<K) is a displaced value in the Y-axis direction;

wherein said profile of said retaining surface contains a coordinate (x', f(x')−K) within an abscissa range between an origin and said center of said valve hole so that said profile is displaced toward said first valve plate with respect to a freely bent shape of said discharge valve element.

7. A compressor according to claim 6, wherein said valve structure comprises said first valve plate having a plurality of additional valve holes in addition to said valve holes and a suction valve plate arranged between said housing and said first valve plate, said suction valve plate having a plurality of flexible suction valve elements corresponding to said cylinder bores and said additional valve holes.

* * * * *